US006979373B1

(12) United States Patent
Rogers

(10) Patent No.: US 6,979,373 B1
(45) Date of Patent: Dec. 27, 2005

(54) VACUUM INLET NOZZLE WHEEL SUPPORT FRAME

(76) Inventor: John S. Rogers, 181 Villa Rita Dr., La Habra, CA (US) 90631

( * ) Notice: Subject to any disclaimer, the term of this patent is extended or adjusted under 35 U.S.C. 154(b) by 365 days.

(21) Appl. No.: 10/402,987

(22) Filed: Apr. 1, 2003

(51) Int. Cl.[7] ..... A47L 9/02
(52) U.S. Cl. ..... 134/21; 15/246.2; 15/415.1
(58) Field of Search ..... 15/49.1, 159.1, 15/325, 328, 329, 338, 353, 354, 415.1, 246, 15/246.2, 246.4; 280/28.18; 134/21

(56) References Cited

U.S. PATENT DOCUMENTS

| | | | | | |
|---|---|---|---|---|---|
| 1,208,165 | A | * | 12/1916 | Kent | 15/415.1 |
| 1,328,737 | A | * | 1/1920 | Hoover | 15/368 |
| 1,333,677 | A | * | 3/1920 | Rauch | 15/355 |
| 1,559,153 | A | * | 10/1925 | Brintzenhofe | 15/354 |
| 1,941,758 | A | * | 1/1934 | Riebel, Jr. | 15/325 |
| 2,091,290 | A | * | 8/1937 | Replogle | 15/393 |
| 2,303,409 | A | * | 12/1942 | Taylor | 15/329 |
| 2,824,335 | A | | 2/1958 | Moffat | 15/345 |
| 3,039,122 | A | * | 6/1962 | Birdsall | 15/1.7 |
| 3,074,087 | A | | 1/1963 | Drennan | 15/1.7 |
| 3,336,623 | A | * | 8/1967 | Coates et al. | 15/354 |
| 3,460,185 | A | * | 8/1969 | Cook | 15/340.1 |
| 4,164,055 | A | * | 8/1979 | Townsend | 15/321 |
| 4,244,080 | A | * | 1/1981 | Wessel | 15/325 |
| 4,358,123 | A | * | 11/1982 | Richards | 280/47.131 |
| 4,590,713 | A | * | 5/1986 | Yasui | 451/357 |
| 5,249,324 | A | | 10/1993 | Giammanco et al. | 15/1.7 |
| 5,819,364 | A | * | 10/1998 | Sham | 15/320 |

* cited by examiner

*Primary Examiner*—Terrence R. Till
(74) *Attorney, Agent, or Firm*—Edgar W. Averill, Jr.

(57) ABSTRACT

A wheel frame for supporting at least two wheels along the bottom surface of a vacuum inlet nozzle of the type commonly used for vacuuming concrete floors of shops and other areas which have cement or wooden floors. The wheel frame is rectangular and has preferably two wheels held by the frame. The frame fits over the conventional vacuum nozzle and snaps over the flange at the bottom of the vacuum nozzle. The wheels are positioned so that they are near the back of the nozzle so that the front edge of the nozzle can be lifted by tilting the nozzle toward the back. This greatly facilitates the vacuuming up of leaves and other larger objects which do not fit under the front edge of the conventional vacuum nozzle.

10 Claims, 2 Drawing Sheets

VACUUM INLET NOZZLE WHEEL SUPPORT FRAME

BACKGROUND OF THE INVENTION

The field of the invention is cleaning tools and the invention relates more particularly to vacuums of the type generally referred to as shop vacuums. Shop vacuums inevitably have injection molded nozzles with an elongated rectangular inlet opening which glides over the floor to be vacuumed. The inlet openings typically have an air inlet notch along both the front, back and side edges. As used herein the term "front" refers to that part of a nozzle which is on the forward edge when the nozzle is being pushed forward and the back is the leading edge when the nozzle is being pulled back. These inlet notches provide an air flow path to attract debris from the floor into the interior of the vacuum nozzle. While such notches work well for dust and dirt, they are too shallow to permit larger objects such as leaves to enter the interior of the vacuum nozzle. As the result, if one is using such a vacuum to clean a patio floor which has a number of leaves or other larger objects on it, the job becomes very tedious. Furthermore, if one tilts the standard plastic injection molded nozzle rearwardly and moves it back and forth over a concrete surface, the back edge of the nozzle is quickly worn down by the abrasive action of the concrete surface.

BRIEF SUMMARY OF THE INVENTION

It is an object of the present invention to provide a means for facilitating the vacuuming up of objects such as leaves from a concrete or wooden surface with a conventional nozzle of the type used with shop vacuums.

The present invention is for a wheel frame for supporting at least two wheels along the bottom surface of a vacuum inlet nozzle. The vacuum inlet nozzle has a generally rectangular inlet opening positionable against a surface to be vacuumed. The inlet nozzle has a nozzle manifold body terminating in a vacuum hose attachment portion. The generally rectangular inlet opening has a peripheral edge, including an outwardly directed flange, along the bottom of the edge. The wheel frame has a front arm shaped to fit over the front edge of the outwardly directed flange. Right and left side arms are shaped to fit over the right and left side edges of the outwardly directed flange. A back arm is shaped to fit over the back edge of the outwardly directed flange. Right and left wheels are held by the wheel frame outwardly from the right side arm near the right side back end thereof and near the left side arm near the left side back end thereof. Means are provided for removably affixing a wheel frame over the outwardly directed flange of the vacuum inlet nozzle. Preferably a pair of hooks are formed outwardly and downwardly from the front arm and the back arm of the wheel frame. Preferably the wheel frame is fabricated from a polymer which provides sufficient flexibility for the hooks to snap over the front and back flanges. The wheels are positioned so that they extend slightly below the wheel frame and allow the vacuum nozzle to be easily tilted backwards to lift the front edge of the nozzle and permit the entry of leaves and other large objects which are too large to pass through the inlet notches. The present invention also includes the process of facilitating the vacuuming up of leaves and other larger objects, as well as small objects, such as sawdust. The process includes the steps of snapping on a wheel frame so that the wheels extend slightly below and near the back edge of the nozzle. After snapping on the wheels, the nozzle is tilted rearwardly to lift the front edge thereof.

DESCRIPTION OF THE PREFERRED EMBODIMENTS

Figure 1:
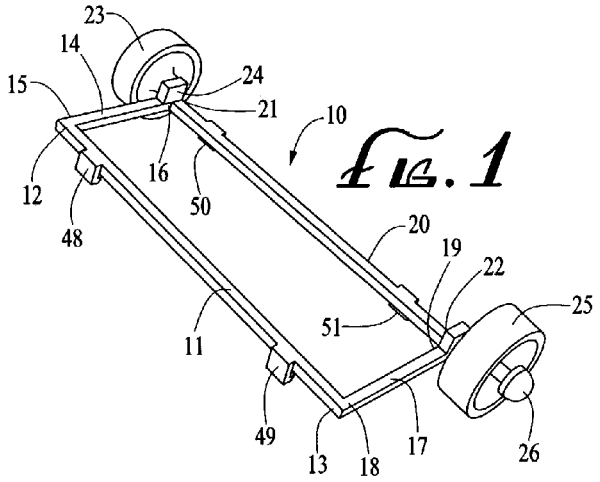
FIG. 1 is a perspective view showing the top, front and right side of the wheel frame of the present invention.

The wheel frame of the present invention is shown in perspective view in FIG. 1 and indicated by reference character 10. Wheel frame 10 has a front arm 11 which has a right end 12 and a left end 13.

Wheel frame 10 has a right side arm 14 with a front end 15 and a back end 16. Left side arm 17 has a front end 18 and a back end 19. Back arm 20 has a right end 21 and a left end 22.

A right wheel 23 has an axle 24 which is about aligned with back arm 20. Left wheel 25 has an axle 26 which is also about aligned with back arm 20. As seen best in FIG. 5, the wheels extend below the lowermost portion of wheel frame 10.

Figure 2:
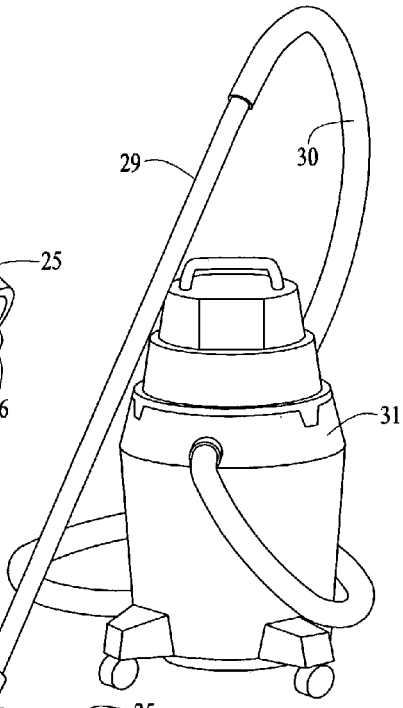
FIG. 2 is a perspective view showing a shop vacuum including a vacuum inlet nozzle to which the wheel frame of FIG. 1 is attached.

As shown in FIG. 2, the wheel frame 10 snaps over a vacuum inlet nozzle 27. Vacuum inlet nozzle 27 includes a vacuum hose attachment portion 28 into which a wand 29 is plugged. A conventional flexible hose 30 is attached to a conventional vacuum body 31.

Figure 3:
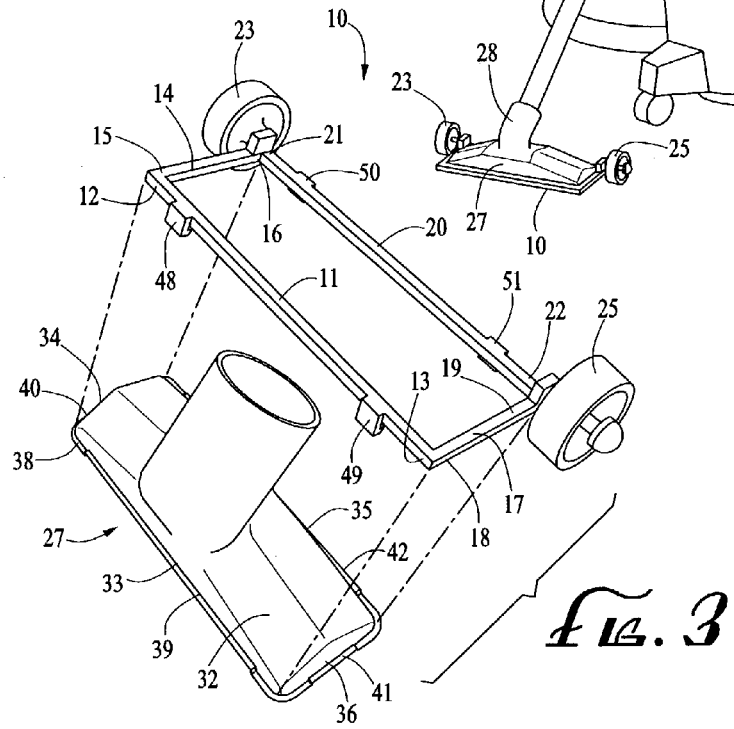
FIG. 3 is an exploded perspective view of the vacuum inlet nozzle and wheel frame of FIG. 2.
Figure 4:
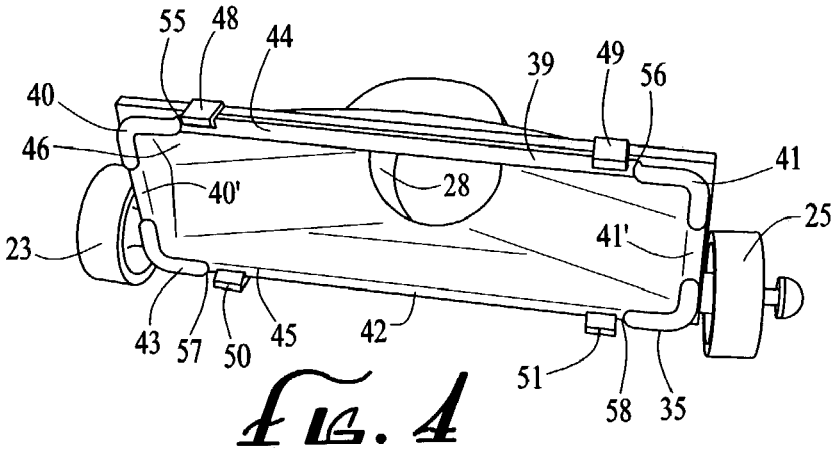
FIG. 4 is a perspective view of the wheel frame and vacuum inlet nozzle of FIG. 3, showing the underside of the vacuum inlet nozzle and wheel frame.
Figure 5:
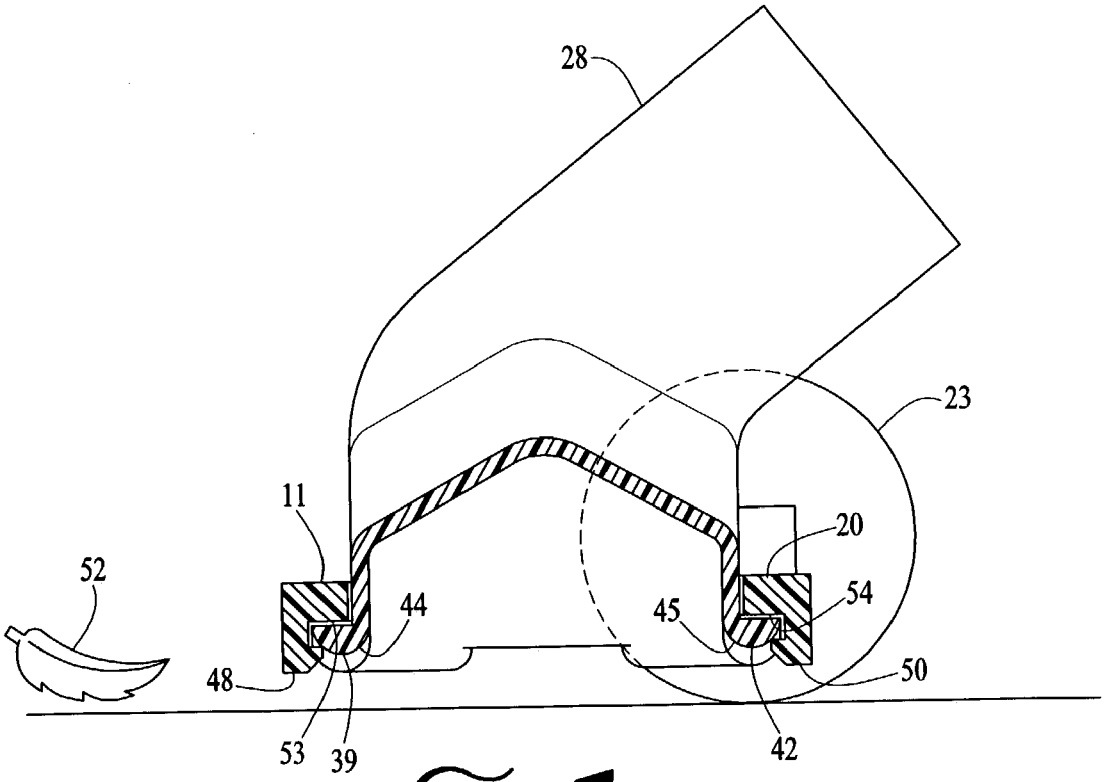
FIG. 5 is a cross-sectional view taken along line 5—5 of FIG. 2.

The details of the nozzle are shown best in FIGS. 3, 4 and 5. Vacuum inlet nozzle 27 has a nozzle manifold body 32, which has a front edge 33, a right side edge 34, a back edge 35, and a left side edge 36. The vacuum inlet opening of nozzle 27 has a generally rectangular peripheral edge made up of edges 33, 34, 35 and 36, which is surrounded by an outwardly directed flange 38. Flange 38 has a front edge 39, a right side edge 40, a left side edge 41, and a back edge 42, shown best in FIG. 4 of the drawings.

Flange 38 has a bottom surface generally indicated by reference character 43 in FIG. 4 which has a front notch 44 along the front edge 39 of the flange. Flange 40 has a notch 40' and flange 41 has a notch 41'. The flange also has a back notch 45, also shown in FIG. 4. The generally rectangular inlet opening 46, when used without the wheel frame of the present invention, permits air to flow through notches 40', 41', 44 and 45 when inlet opening 46 is placed against a flat concrete surface. This prevents a large downward pull which would be created by a higher vacuum if this rectangular opening were placed a concrete floor without such notches.

While notches 40', 41', 44 and 45 are useful for providing a relatively high velocity flow of air between the under surface of the notch and the floor, they are not high enough to permit objects such as leaves to pass into the interior of the vacuum nozzle body.

Whereas the inlet nozzle 27 can be tilted rearwardly to lift the front edge, if one is trying to vacuum a large number of leaves from a patio floor, this backward tilting and resulting dragging of the back edge against a concrete surface is tedious and time-consuming. It also causes a great deal of wear along the back edge 35 of the nozzle, particularly when used on concrete surfaces.

To alleviate this problem, a wheel frame 10 of the present invention may be snapped over a conventional nozzle and provide a means for greatly facilitating the vacuuming up of leaves or other objects. This process is indicated in FIG. 3 where wheel frame 10 can be seen to have four hooks 48, 49, 50 and 51. The arms of the frame are preferably fabricated from a polymer, such as commonly used for vacuum nozzles, so that there is some flexibility in the arms to permit the hooks to snap over the front edge 39 of the outwardly directed flange 38. Hooks 48 and 50 snap over the back and front edges 39 and 42 of flange 38, as shown best in FIG. 5 of the drawings.

The wheels then greatly facilitate the raising of the front edge 33 of nozzle 27 so that leaf 52 easily fits into the interior of nozzle 27.

Preferably, the bottom surface 53 of front arm 11 abuts the upper surface flange 39. Similarly, the bottom surface 54 of back arm 20 also abuts the upper surface of outwardly directed flange 42. Also, as seen best in FIG. 4 of the drawings, the front notch 44 has a right end 55 and a left end 56 and hooks 48 and 49 are positioned so that they lie adjacent the ends 55 and 56. As shown in FIG. 5, this causes the hooks to not extend below the bottom surface of the vacuum inlet nozzle 27, since they are held in the front notch 44. Similarly, back notch 45 has a right end 57 and a left end 58 and hooks 50 and 51 are positioned so that they seat adjacent right and left ends 57 and 58, respectively.

While the pair of front and back hooks are shown, the hooks could alternatively be positioned on the sides of frame 10.

While a pair of front hooks and a pair of back hooks is shown as a means of removably affixing the wheel frame, other attachment methods could be used, such as a U-shaped channel which could snap under the notch and over the wheel frame front arm, and similarly, under the notch in the back edge and over the back arm of the frame. Screws, nuts and bolts, hook and eye fasteners of the type sold under the trademark "Velcro" and other attachments are also contemplated.

It is advantageous that the wheel frame of the present invention be designed to fit over a conventional vacuum nozzle so that the wheel frame can be used as an after-market device for nozzles that are already in use. It is contemplated that the wheel frame would be removed for some vacuuming operations and snapped on when larger objects are present for removal by vacuuming.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A wheel frame for supporting at least two wheels along a bottom surface of a vacuum inlet nozzle, said vacuum inlet nozzle having a generally rectangular inlet opening positionable against a surface to be vacuumed, a nozzle manifold body terminating in a vacuum hose attachment portion, said generally rectangular inlet opening having a generally rectangular peripheral edge including an outwardly directed flange along a bottom of said generally rectangular peripheral edge and said outwardly directed flange having a front edge, a right side edge, a left side edge and a back edge, said wheel frame comprising:

a front arm shaped to fit over said front edge of said outwardly directed flange, said front arm having a bottom surface which contacts at least a portion of a top surface of said nozzle manifold body and said front arm having a right end and a left end;

a right side arm shaped to fit over said right side edge of said outwardly directed flange and said right side arm having a right side front end attached to said right end of said front arm and a right side back end;

a left side arm shaped to fit over said left side edge of said outwardly directed flange and said left side arm having a left side front end attached to said left end of said front arm and a left side back end;

a back arm shaped to fit over said back edge of said outwardly directed flange, said back arm having a bottom surface which contacts at least a portion of said top surface of said nozzle manifold body and said back arm having a right end and a left end;

a right wheel held by said wheel frame outwardly from said right side arm near the right side back end thereof, said right wheel having a wheel surface which extends below said wheel frame;

a left wheel held by said wheel frame outwardly from said left side arm near the left side back end thereof, said left wheel having a wheel surface which extends below said wheel frame; and means for removably affixing said wheel frame over said outwardly directed flange of said vacuum inlet nozzle.

2. The wheel frame of claim 1 wherein said front arm contacts at least a portion of said front edge of said outwardly directed flange.

3. The wheel frame of claim 1 wherein said back arm contacts at least a portion of said back edge of said outwardly directed flange.

4. The wheel frame of claim 1 wherein said means for removably affixing said wheel frame over said outwardly directed flange of said vacuum inlet nozzle comprises at least one hook extending downwardly from said front arm and shaped to clamp over an under surface of said front edge of said outwardly directed flange and at least one hook extending downwardly from said back arm and shaped to clamp over an under surface of said back edge of said outwardly directed flange.

5. The wheel frame of claim 4 wherein there are two hooks extending downwardly from said front arm and two hooks extending downwardly from said back arm.

6. The wheel frame of claim 1 wherein said wheel frame is injection molded from a polymer.

7. The wheel frame of claim 1 wherein said right wheel and said left wheel each have an axle about aligned with said back arm.

8. A wheel frame for removably supporting wheels along the back of a bottom surface of a vacuum inlet nozzle, said vacuum inlet nozzle having a generally rectangular inlet opening positionable against a surface to be vacuumed, a nozzle manifold body terminating in a vacuum hose attachment portion, said generally rectangular inlet opening having a generally rectangular peripheral edge including an outwardly directed flange along a bottom of said generally rectangular peripheral edge and said outwardly directed flange having a front edge, a right side edge, a left side edge and a back edge, said wheel frame comprising:

a front arm shaped to fit over said front edge of said outwardly directed flange, said front arm having a bottom surface which contacts at least a portion of a top surface of said front edge of said outwardly directed flange and said front arm having a right end and a left end;

a right side arm shaped to fit over said right side edge of said outwardly directed flange and said right side arm having a right side front end attached to said right end of said front arm and a right side back end;

a left side arm shaped to fit over said left side edge of said outwardly directed flange and said left side arm having a left side front end attached to said left end of said front arm and a left side back end;

a back arm shaped to fit over said back edge of said outwardly directed flange, said back arm having a bottom surface which contacts at least a portion of said top surface of said back edge of said outwardly directed flange and said back arm having a right end and a left end;

a right wheel held by said wheel frame outwardly from said right side arm near the right side back end thereof, said right wheel having a wheel surface which extends below said wheel frame;

a left wheel held by said wheel frame outwardly from said left side arm near the left side back end thereof, said left wheel having a wheel surface which extends below said wheel frame; and at least two hook members extending downwardly from said front arm and configured to have a hook portion which extends over a front edge and under an under surface of said front edge of said outwardly directed flange and at least two hook members extending downwardly from said back arm and means configured to have a hook portion which extends over a back edge and under an under surface of said back edge of said outwardly directed flange and said wheel frame being fabricated from a flexible polymer for removably affixing said wheel frame over said outwardly directed flange of said vacuum inlet nozzle.

9. The wheel frame of claim 8 wherein said vacuum inlet nozzle has a raised air inlet length having a right end and a left end, said air inlet length formed along said front edge and said back edge of said generally rectangular inlet opening and said at least two hook members on both said front arm and said back arm are positioned to fit adjacent said right end and said left end of each of said raised air inlet lengths.

10. A process for facilitating the vacuuming up of objects such a as leaves from a flat surface utilizing a vacuum inlet nozzle having a generally rectangular inlet opening positionable against a surface to be vacuumed, a nozzle manifold body terminating in a vacuum hose attachment portion, said generally rectangular inlet opening having a generally rectangular peripheral edge including an outwardly directed flange along a bottom of said generally rectangular peripheral edge and said outwardly directed flange having a front edge, a right side edge, a left side edge and a back edge, said vacuum inlet nozzle having no wheels, said process comprising:

snapping a wheel frame over said outwardly directed flange, said wheel frame having a front arm, a right side arm, a left side arm and a back arm and having a right wheel extending outwardly from said right side arm near said back arm and a left wheel extending outwardly from said left side arm near said back arm over said outwardly directed flange so that said right wheel and said left wheel extend partly below said generally rectangular inlet opening;

placing said wheels against said flat surface and tilting said vacuum inlet nozzle backwards thereby lifting said front edge of said flange and facilitating the vacuuming up of said objects by raising the front edge of said flange up from said flat surface.

* * * * *